US005588878A

United States Patent [19]

Flinchbaugh et al.

[11] Patent Number: 5,588,878

[45] Date of Patent: Dec. 31, 1996

[54] ELECTRICAL RECEPTACLE ASSEMBLY AND SPRING CONTACT THEREFOR

[75] Inventors: Bernadette M. Flinchbaugh, York Haven; Andrew J. Gabany, Mechanicsburg; Adrian L. Melnyk, York; Christopher J. Schmid, Harrisburg, all of Pa.

[73] Assignee: The Whitaker Corporation, Wilmington, Del.

[21] Appl. No.: 404,410

[22] Filed: Mar. 14, 1995

[51] Int. Cl.[6] ..... H01R 13/10

[52] U.S. Cl. ..... 439/682; 439/636; 439/83

[58] Field of Search ..... 439/78, 83, 636, 439/637, 733.1, 682, 752.5, 862

[56] References Cited

U.S. PATENT DOCUMENTS

| | | | |
|---|---|---|---|
| 3,740,699 | 6/1973 | Johnson et al. | 439/637 |
| 3,858,163 | 12/1974 | Goodman et al. . | |
| 4,036,544 | 7/1977 | Keglewitsch . | |
| 4,220,393 | 9/1980 | Ammon et al. | 439/682 |
| 4,556,267 | 12/1985 | Senor . | |
| 4,560,218 | 12/1985 | Billman et al. | 439/682 X |
| 4,767,342 | 8/1988 | Sato | 439/78 |
| 4,778,396 | 10/1988 | Spooren | 439/82 |
| 4,802,860 | 2/1989 | Kikuta | 439/79 |
| 4,906,198 | 3/1990 | Cosimano et al. | 439/82 |
| 5,131,872 | 7/1992 | Consoli et al. | 439/751 |
| 5,161,985 | 11/1992 | Ramsey | 439/74 |
| 5,199,880 | 4/1993 | Arai | 439/65 |
| 5,213,514 | 5/1993 | Arai | 439/79 |
| 5,224,866 | 7/1993 | Nakamura et al. | 439/81 |
| 5,256,085 | 10/1993 | Tan et al. | 439/607 |
| 5,259,793 | 11/1993 | Yamada et al. | 439/637 |
| 5,403,209 | 4/1995 | Lytle | 439/682 |

FOREIGN PATENT DOCUMENTS

| | | |
|---|---|---|
| 0139786 | 8/1985 | European Pat. Off. . |
| 0638960A2 | 2/1995 | European Pat. Off. . |
| 62157411 | 4/1988 | Japan . |

OTHER PUBLICATIONS

PCT International Publication No. WO/86/01040.

PCT Search Report International Application No. PCT/US96/00432.

*Primary Examiner*—Khiem Nguyen

[57] ABSTRACT

An electrical receptacle connector assembly (4) for application to a printed circuit board consists of an insulating housing (6) and spring contacts (8) received in cavities (9) in the housing. The cavities are T-shaped having a portion that is substantially rectangular, constant cross section from a contact receiving face (12) of the housing (6) up to a position proximate to a mating face (10) of the housing and a contact retention slot (15) along one side thereof. Each spring contact (8) consists of a forward leaf contact spring (32), an intermediate retention portion (33) with retention ears (48), and a rearward contact tail (34) for soldering to a conductor on the circuit board. In each cavity (9) the retention portion (33) and a flat end portion of the leaf spring (32) lie flat against one face (24) of the cavity (9), the leaf spring being bowed towards the opposite face (26) of the cavity, with the retention ears (48) biting into surfaces of slots (15) and the contact tail (34) projecting from the contact receiving face (12) of the housing (6). The housing and the spring contacts are simple and economical to manufacture and the spring contacts are easy to load into the cavities. The contact tails can be configured for various modes of mounting the assembly on the circuit board.

20 Claims, 7 Drawing Sheets

ELECTRICAL RECEPTACLE ASSEMBLY AND SPRING CONTACT THEREFOR

FIELD OF THE INVENTION

This invention relates to a receptacle assembly for application to a printed circuit board, and a spring contact therefor and more particularly to an assembly which is "universal" in the sense that it can be produced as a vertical, a horizontal, a through hole or a surface mount, receptacle assembly.

BACKGROUND OF THE INVENTION

With the increased interest in miniaturization and further in the interest of cost effective manufacturing of electrical assemblies it is desirable that the assembly consist of an insulating housing which is simple to mold using only straight action core pins, and spring contacts which are of uncomplicated structure. Preferably the spring contacts can be easily stamped and formed from sheet metal stock, without folding operations having to be performed on the stock and can be very simply loaded into the housing. In the interest of universality contact springs of the spring contacts should be identical regardless of the mode in which the assembly is to be mounted on a printed circuit board, only the contact tails of the spring contacts needing to be modified according to the mode in which the assembly is to be used. Also, the assembly should be mateable with pins of a conventional pin header without the housing of the pin header being especially configured to mate with the receptacle assembly.

Many receptacle assemblies for application to printed circuit boards are known, but none has either all of, or many of, the advantages set forth above. U.S. Pat. Nos. 5,161,985; 5,199,880; 5,213, 514; and 5,224,866 all disclose receptacle assemblies for application to printed circuit boards, in which the insulating housing of the assembly is specially configured to mate with a specially configured housing of a pin header. The housing of the receptacle assembly is accordingly a somewhat complicated molding. Further, the receptacle assemblies are suitable only for one mode of mounting to a printed circuit board.

U.S. Pat. Nos. 4,556,267; 4,767,342 and 5,131,872 disclose receptacle assemblies for application to printed circuit boards, in which spring contacts have contact springs that require folding operations during manufacture and the receptacle assemblies are arranged only for vertical mounting to a printed circuit board. U.S. Pat. No. 4,778,396 discloses a receptacle assembly for application to a printed circuit board, in which the spring contacts are relatively simple contact springs, but in which spring contacts are secured in their housing by means of ears which are bent out of the plane of a retention portion of the spring contact and are of much greater stock thickness than the contact spring. The housing is specially configured to cooperate with the retention ears so that the spring contact is contained in its cavity in the housing. U.S. Pat. No. 3,858,163 discloses an edge connector for connecting two printed circuit boards with their edges in opposite alignment. The connector comprises two mating housings with cavities receiving spring contacts having oppositely directed contact springs each of which is located in a cavity in a respective one of the housings. Although the contact springs are of relatively simple construction, the spring contacts have no contact tails and the housings are not arranged to be mounted on a printed circuit board. U.S. Pat. No. 5,259,793 discloses a receptacle assembly for mounting on a mother printed circuit board to connect a daughter board thereto. A cavity in the housing of the assembly is configured to receive S-shaped contact springs of the spring contacts which are retained in the housing by means of barbed support portions which are lodged in grooves formed in a terminal receiving face of the housing.

SUMMARY OF THE INVENTION

According to an aspect of the present invention, an electrical receptacle assembly for application to a circuit board comprises an insulating housing having a rectangular cross section which defines at least one row of contact receiving cavities each of which opens into opposite contact receiving, and mating, faces of the housing. Each cavity is essentially T-shaped having a rectangular contact receiving portion and a contact retention slot defining a cross bar of the "T" and extending along one surface of the contact receiving portion. The contact receiving portion is of constant cross section which is defined by four orthogonally arranged, flat, elongate surfaces extending substantially from the contact receiving face of the housing to a position proximate to the mating face and two oppositely directed slot portions along one surface thereof and adapted to receive the retention portion of a contact disposed in the cavity. The assembly further comprises a spring contact in each cavity which consists of a forward leaf contact spring, an intermediate planar retention portion having oppositely projecting retention ears, and a rearward contact tail extending from the retention portion and projecting from the contact receiving face of the housing. The retention portion is secured against a first one of the four flat elongate surfaces defining the cavity, by the retention ears which are received in the retention slot extending along the first surface and which bite into the surface thereof. The contact spring is bowed away from the first flat surface towards the opposite flat surface defining the cavity, and has a flat forward end portion engaging against the first flat surface. An electrical pin, in particular a square cross sectional pin can be inserted axially into the cavity to engage said opposite flat surface and thus to depress the contact spring towards the first flat surface.

By virtue of the configuration of the cavities, the housing can be very simply molded with the use of straight action core pins, the spring contacts being easily manufactured by means of a progressive die stamping and forming operation from sheet metal stock with no folding operation needing to be carried out in order to form the contact springs. The spring contacts can readily be loaded into their cavities since all that it is necessary to do is to insert the spring contact into its cavity with the contact spring leading with the forward end portion of the contact spring sliding along the one surface defining the cavity, until the ears of the retention portion engage and bite into, their respective slot portions of the cavity. The parts of the contact tails which project from the contact receiving face of the housing, can be bent during manufacture, for example, to provide for vertical or surface mounting of the assembly to a printed circuit board, or, by virtue of the rectangular cross sectional shape of the housing, the housing can be mounted horizontally on the circuit board, in which case, the projecting parts of the contact tails are bent down for insertion in respective holes in the circuit board.

By virtue of the simple structure of the housing and the spring contacts, and the ease with which they can be loaded into the housing, the assembly is compatible with global manufacture.

Preferably, a ledge or stop surface is provided in each cavity near the mating face of the housing, to engage the free end of the contact spring of the spring contact in the cavity, so that the inserted pin causes the contact spring to be stressed between the ledge and the retention portion of the spring contact. The contact tails may be so disposed that the pins can be inserted into the cavities by way of the contact receiving face of the housing.

A stamped and formed spring contact according to the invention, consists of a forward leaf contact spring, an intermediate retention portion and a rearward contact tail. The contact spring extends from the retention portion in the opposite direction to the contact tail and the contact spring has a forward end portion which is coplanar with the retention portion, a rectilinear forward section extending obliquely rearwardly from the forward end portion of the contact spring, and a rectilinear rear section extending obliquely forwardly from the retention portion. The forward and rear sections of the contact spring cooperate to define a bight having an apex for engagement with an electrical post. The apex is displaced from a common plane of the rectilinear portion and the forward end portion of the contact spring, at right angles to the common plane.

The contact tails may be made of any length and configuration that is suitable for enabling the connector assembly to be mounted to a printed circuit board in any desired mode.

Embodiments of the present invention will now be described by way of example with reference to the accompanying drawings.

DETAILED DESCRIPTION OF THE PREFERRED EMBODIMENTS

Reference will now be made to FIGS. 1 to 9. A multi-contact electrical receptacle assembly 4 for application to a printed circuit board, comprises an insulating housing 6 and two rows of spring contacts 8.

Figure 2:
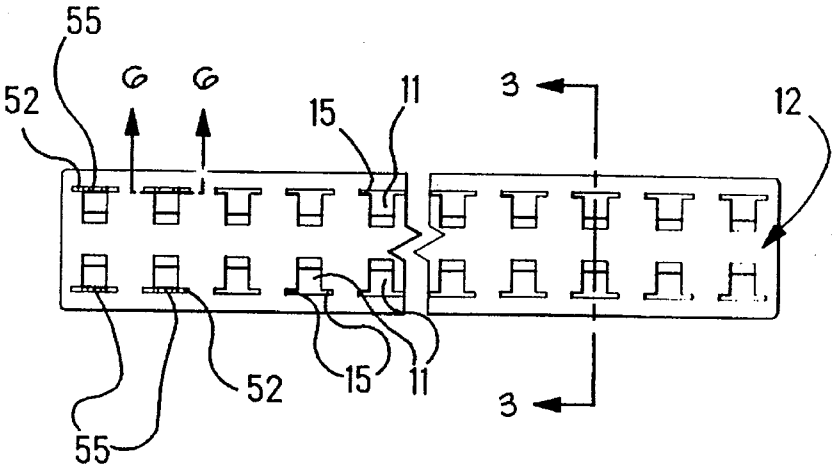
FIG. 2 is a plan view of the contact receiving face of the multi-contact electrical receptacle assembly of FIG. 1.
Figure 1:
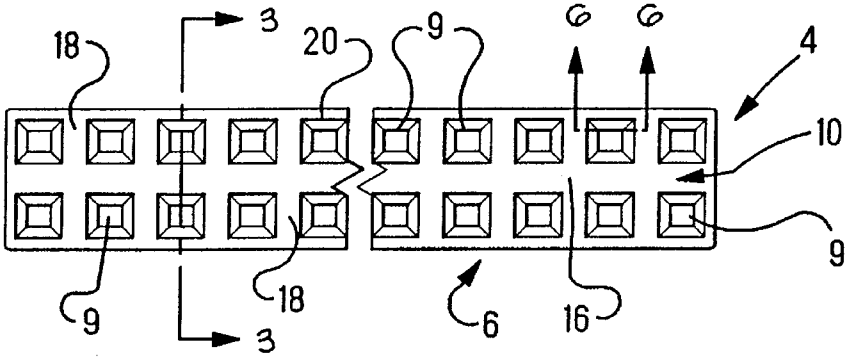
FIG. 1 is a plan view of the mating face of a multi-contact electrical receptacle assembly for application to a printed circuit board.

The housing 6 which is preferably of elongate, rectangular cross section is made of fully regrindable material, for example VALOX thermoplastic resin (trademark of GE Company, Fairfield Conn.) material, so that it is fully recyclable after the end of its useful life. The housing 6 defines two rows of evenly spaced, contact receiving, through cavities 9 each opening at one end into a mating face 10 of the housing 6 and at its opposite end into a contact receiving face 12 of the housing 6. Each cavity 9 is bounded laterally by a respective side wall 14 of the housing 6, centrally by a central wall 16 of the housing 6 and in the longitudinal direction of the housing 6, by respective partition walls 18. The cavities 9 are all of identical size and configuration. As best seen in FIG. 2, each contact receiving cavity 9 is essentially "T" shaped. Each cavity 9 has a rectangular contact receiving portion 11 and a cross bar or slot portion 15 extending outwardly from the contact receiving portion 11 in opposite directions along sidewall 14. Each cavity 9 has a pin guiding mouth 20 opening into the mating face 10. Proximate to the mouth 20 each side wall 14 presents an abutment ledge or contact stop surface 22 extending normally across the respective cavity 9 and defining the end of contact retention slot 15. The side wall 14 has, in each cavity 9, a flat, elongate, internal surface 24, which is parallel to an opposite, flat, external, elongate surface 26, of the central wall 16. Each partition 18 has, in each cavity 9, a flat internal, elongate, surface 28 which is adjacent to the surfaces 24 and 26. Thus, as will best be appreciated from FIGS. 6 and 7, each contact receiving portion 11 of cavity 9 is defined by four flat, elongate, orthogonally arranged surfaces, namely the opposed surfaces 24, and 26, and opposed partition surfaces 28, between the ledge 22 and the contact receiving face 12. These surfaces define a hollow rectangle as seen in cross section. The terminal receiving face 12 is formed with standoffs 30 (only one of which is shown) spaced from one another lengthwise of the housing 6. By virtue of the simple configuration of the cavities 9, the housing 6 is readily, and economically molded by means of simple tooling, using straight action core pins.

Figure 4:
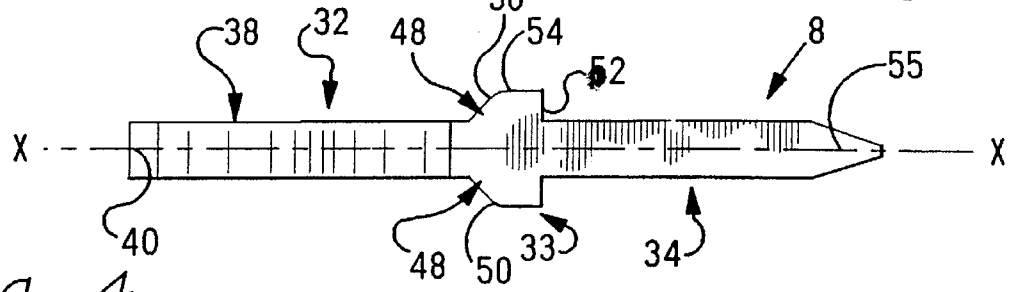
FIG. 4 is a plan view of spring contact of the assembly.
Figure 5:
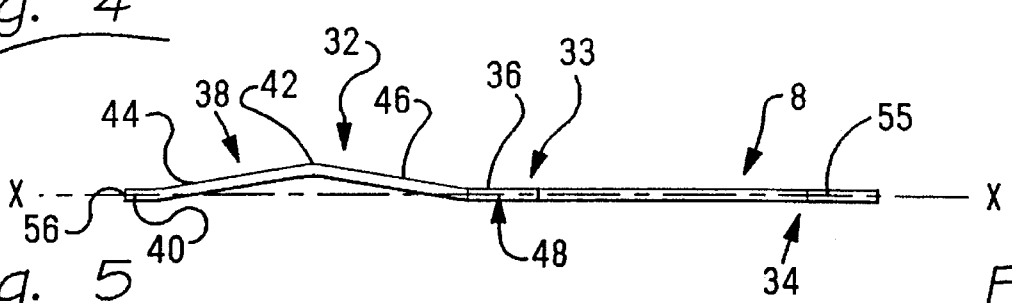
FIG. 5 is a side view of the contact shown in FIG. 4.

Each spring contact 8 which has been stamped and formed from a single piece of brass stock consists, as best seen in FIGS. 4 and 5, of a forward contact leaf spring 32, an intermediate retention portion 33 and a rearward contact tail 34. The retention portion 33 and the contact tail 34 are uniplanar. The contact tail 34 may be bent from its own plane, according to the mode of use of the receptacle 4, as explained in detail below. The contact spring 32 consists of a first flat portion 36 adjacent to the retention portion 33, a contact portion 38 bowed out of the plane of the remainder of the spring contact 8, and a second flat portion 40 at the forward end of the bowed contact portion 38. The flat portion 40 is coplanar with the flat portion 36, the retention portion 33 and the contact tail 34, as will be apparent from the broken line X—X which is the longitudinal central axis of the spring contact 8. The bowed contact portion 38 has a rounded apex 42 which is spaced from the plane of the remainder of the spring contact 8 by approximately the stock thickness of the contact 8. From the apex 42 rectilinear, forward and rear sections 44 and 46, respectively, of substantially the same length, extend and define between them, an obtuse angle. The section 44 extends obliquely rearwardly from the flat portion 40, the section 46 extending obliquely forwardly from the flat portion 36. The retention position 33 has forwardly tapered, opposed, laterally projecting retention ears 48, each having a rounded forward corner 50, a rear shoulder 52 and a rectilinear lateral edge 54 connecting the corner 50 to the shoulder 52. The contact tail 34 has a rearwardly tapered rear end portion 55 for insertion through a hole in a printed circuit board.

Figure 3:
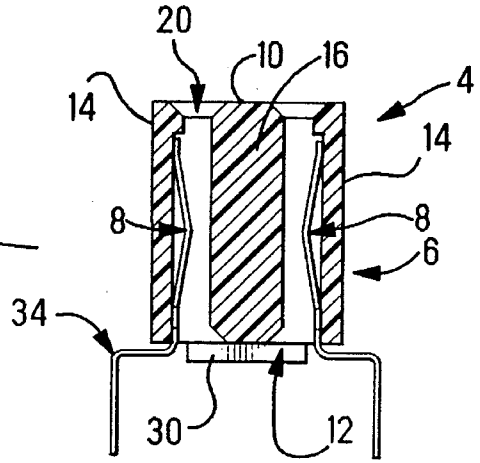
FIG. 3 is a cross sectional view taken on the lines 3—3 of FIGS. 1 and 2.
Figure 6:
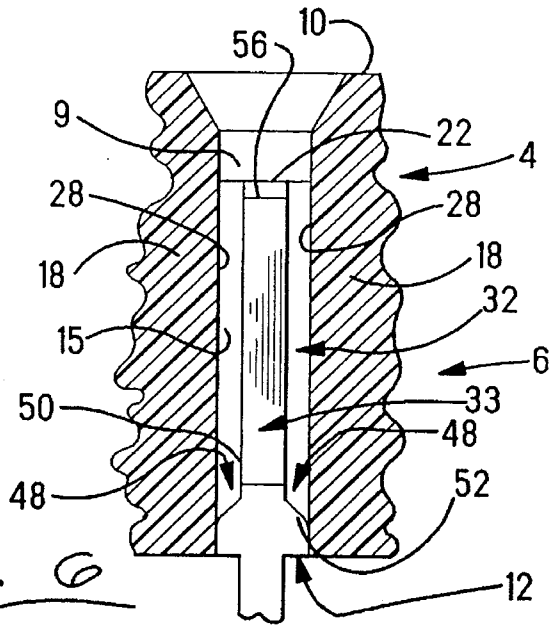
FIG. 6 is an enlarged view taken on the lines 6—6 of FIGS. 1 and 2.
Figure 7:
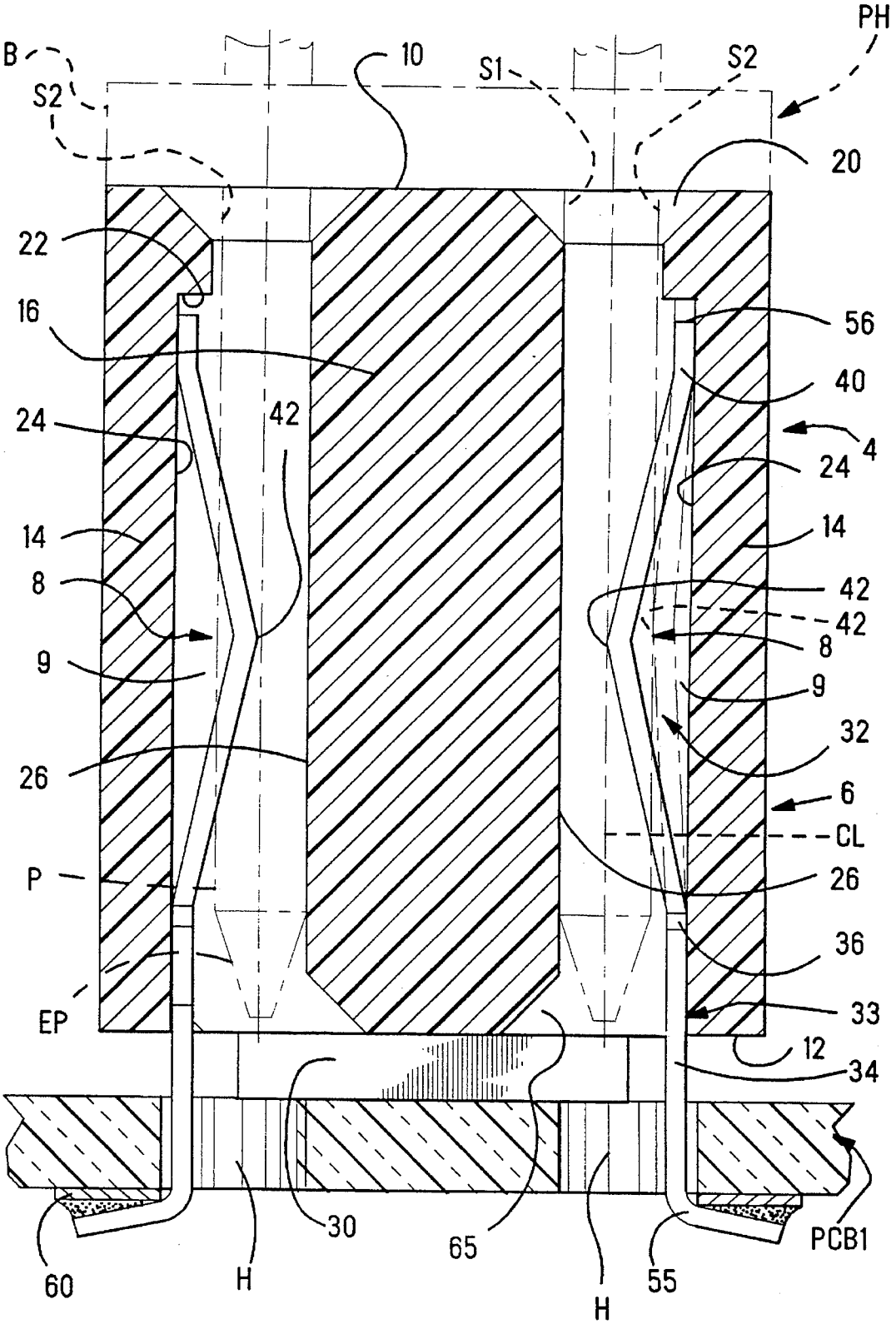
FIG. 7 is an enlarged view similar to that of FIG. 3 showing, in broken lines, square cross section pins mated with the receptacle assembly.
Figure 11:
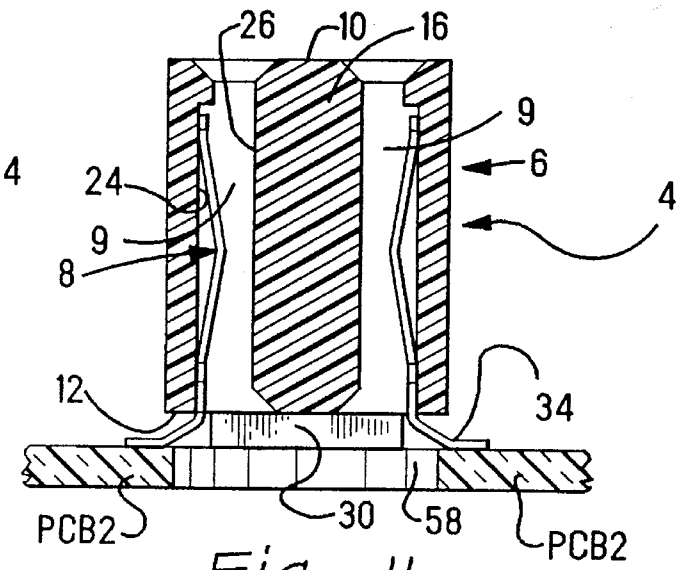
FIGS. 10 and 11 are similar views to that of FIG. 3 but showing the contact tails bent for application of the assembly to a printed circuit board in second and third modes, respectively.
Figure 9:
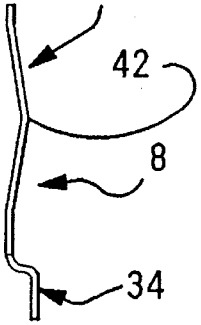
FIG. 9 is a side view of a spring contact of the assembly showing a contact tail thereof bent for application of the assembly to a printed circuit board in a first mode.
Figure 12:
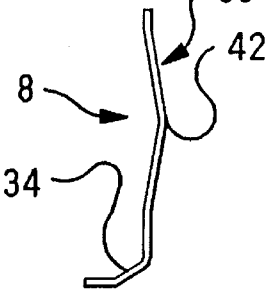
FIG. 12 is a side view of a spring contact of the assembly as shown in FIG. 10.

FIGS. 6 and 7 show the position of the spring contact 8 in the housing. FIG. 6 is taken along lines 6—6 of FIGS. 1 and 2 and illustrates the portions of contact 8 that are disposed in the retention slot 15 of cavity 9. FIG. 7 is a cross sectional view taken through two of the cavities 9. Each spring contact 8 is inserted into its respective cavity 9 by way of the contact receiving face 12, with the flat portion 40 of the contact spring leading and sliding against the surface 24 of the respective outer wall 14, until the retention ears 48 bite into the surfaces of the slots 15, aided by the rounded corners 50, whereby the shoulders 52 prevent withdrawal of the spring contact 8 from its cavity 9 (FIG. 6). In this fully inserted position of the spring contact 8, the leading end 56 of the contact spring 32 lies proximate to the ledge 22 of the side wall 14, as shown in FIGS. 6 and 7, with the flat portions 36 and 40, the retention portion 33 and the adjacent part of the contact tail 34, lying flat against the surface 24, as shown in FIG. 7. The greater part of the contact tail 34 projects rearwardly from the contact receiving face 12. The contact tail 34 may extend rectilinearly from the face 12, or may be bent into various configurations, as shown in FIGS. 3, 9, and 11, for example. The end user, having being supplied with the receptacle assembly 4, inserts each contact tail 34 through a respective plated through hole H in a printed circuit board PCB 1 aided by the tapered end portion 55 of the contact tail 34 and bends the tail along the undersurface of PCB 1. The end user then wave solders the tapered end 55 to printed conductors 60 on the board PCB 1. The standoffs 30 raise the housing 6 above the printed circuit board so that the housing 6 is protected from the soldering heat and to allow for cleaning and inspecting the soldered area, as known in the art.

The receptacle assembly 4 is now ready to be mated with a pin header PH, shown in broken lines in FIG. 7. In this example, the pins P are inserted from the mating face 10. Alternatively, it is to be understood that pins may also be inserted into the through holes H from the undersurface of PCB 1 and into the respective cavities 9. The pin header has a square cross section pin P for reception in each cavity 9. Each pin P has a forwardly tapered mating end portion EP. As the pin is inserted into its cavity 9 through the mouth 20, with its end EP leading, one side S1 of each pin P slides along the respective surface 26 of the central wall 16 of the housing 6, until the body B of the pin header PH bottoms on the mating face 10. During the insertion of each pin P, its tapered end portion EP engages the apex 42 of the contact spring 32 in the respective cavity 9 and so presses the spring 42 resiliently towards the surface 24 of the side wall 14 until the end 56 of the spring 32 is stopped against the ledge 22, the opposite side S2 of the pin P sliding along the contact spring 32, as shown in phantom in the right hand cavity 9 of FIG. 7. A normal contact force of 200 grams, for example, is exerted against the pin, when the end 56 of the contact spring 32 is stopped against the abutment ledge 22 whereby the spring 42 is stressed between the ledge 22 and the retention portion 33 which is fixed to the partitions 18 as described above. The pins P are thereby electrically connected to respective printed conductors on the board PCB 1. The extent of the flexure of the contact spring 32, that is to say the extent to which the apex 42 is depressed, is indicated in FIG. 7 by the distance between the side S2 of the pin P and an imaginary broken line CL. The extent of said flexure is slightly less than the stock thickness of the spring contact 8.

Figure 8:
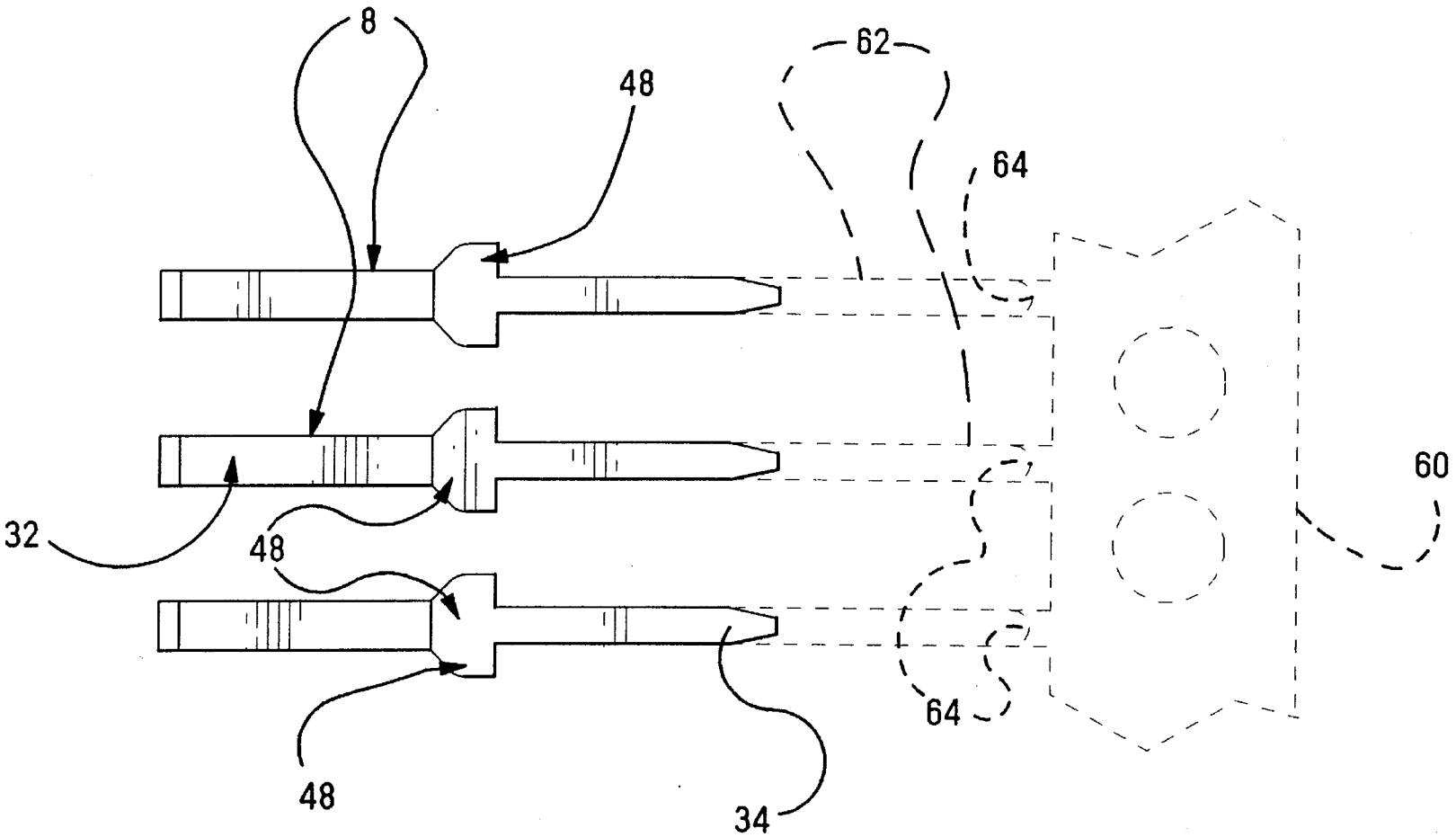
FIG. 8 is a plan view showing part of a strip of spring contacts for the receptacle assembly, carrier strips connecting the contacts and optional contact lengths being shown in broken lines.

As will be apparent from FIG. 8, the spring contacts 8 may be readily manufactured in a side strip form by means of a progressive die stamping and forming operation, leaving a carrier strip 60, shown in broken lines, connected by slugs 62 to the contact tails 34 of the spring contacts 8. The contact tails 34 may be made in a variety of lengths such as indicated by broken lines 64. The strip of contacts 8 can be supplied to a contact stitching machine (not shown) for slugging out the slugs 62 and stitching contacts into their respective cavities 9. Alternatively the contacts 8 may be "gangloaded", that is inserted into respective cavities 9 while attached to carrier strip 60, the carrier strip being cut off either before or after contact tails have been formed into the desired configuration.

The contact tails 34 may be bent in an "outboard" through hole configuration such as shown in FIG. 3, either before or after, the insertion of the spring contact 8 into its cavity 9. As shown in FIG. 9, the contact tails 34 may be bent so as to extend outwardly of the housing side walls 14 and parallel with the board engaging surfaces of the standoffs 30, for soldering to conductors (not shown) on the upper surface of a printed circuit board. As shown in FIG. 11, the contact tails 34 may be bent outwardly of the side walls 14 for soldering to printed conductors on opposite sides of a hole 58 in a printed circuit board PCB 2. In this mode of use of the assembly 4 mating pins can be inserted into the cavities 9 by way either of the mating face 10 or the contact receiving face 12 into which open pin guiding mouths 65.

Figure 10:
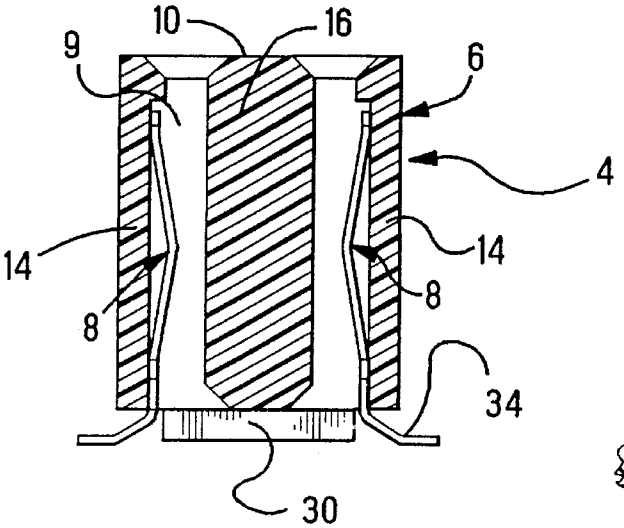
Figure 13:
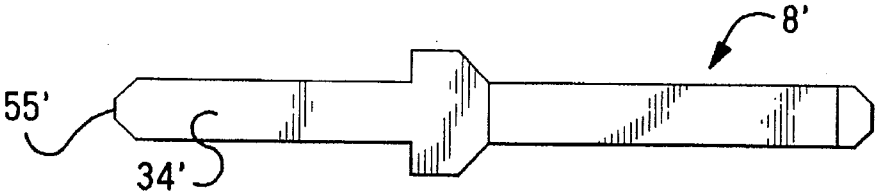
FIG. 13 is a plan view of a modified version of the spring contact for use in the assemblies as shown in FIGS. 10 and 11.

FIG. 13 shows a modified spring contact 8' in which the contact tail 34' has a blunt rear end portion 55' for use with the modes of FIGS. 10 and 11, that is to say for soldering flat against conductors on a printed circuit board.

Figure 14:
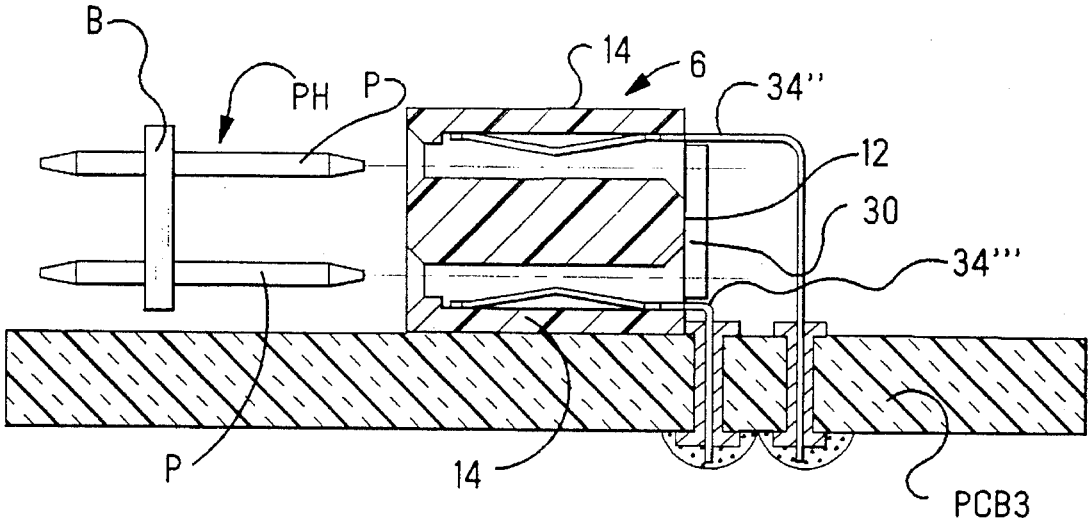
FIG. 14 is a cross sectional view of a receptacle assembly mounted in a fourth mode on a printed circuit board and showing a pin header about to be mated with the receptacle assembly.

FIG. 14 shows the housing 6 applied to a printed circuit board PCB 3 in a horizontal mode for mating with a pin header advanced with its pins P parallel the board PCB 3. The contacts in the housing 6 are identical with the spring contacts 8 excepting that the spring contacts in the upper row cavities of the housing 6 have contact tails 34" which are longer than the contact tails 34 and which have been bent down at right angles at positions remote from the contact receiving face 12 of the housing 6. Similarly, the spring contacts in the lower row of cavities in the housing 6 have contact tails 34''' which are shorter than the contact tails 34" and have been bent down at right angles proximate to the contact receiving face 12. As shown in FIG. 14 the vertical parts of the contact tails 34" and 34'" have been inserted through holes in the printed circuit board PCB 3 for soldering to respective conductors thereon. The standoffs 30 are not utilized in this example since the housing 6 is laterally displaced from the soldering sites.

Figure 15:
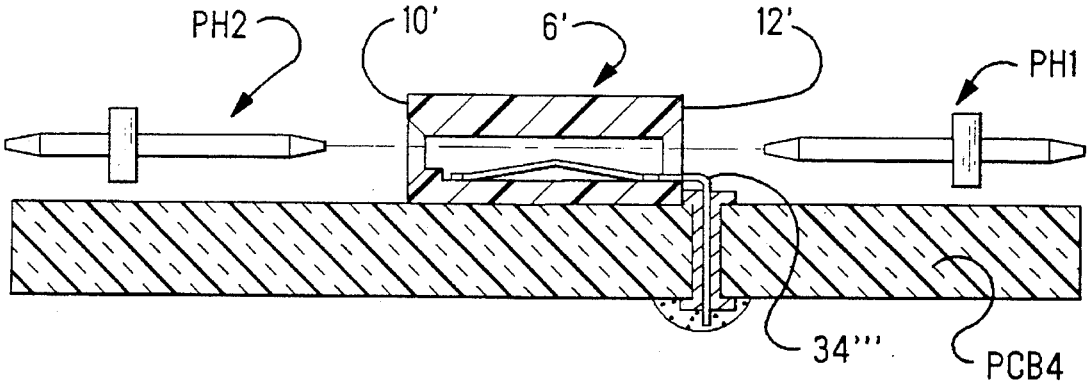
FIG. 15 is a cross sectional view of another embodiment of the receptacle assembly having a single row of spring contacts and being mounted horizontally on a printed circuit board, the pin headers being shown positioned for mating with the receptacle assembly from opposite sides thereof.

FIG. 15 shows a receptacle connector assembly having a housing 6' with a single row of contact receiving cavities each identical with the cavities 9 described above. The spring contacts in the cavities are identical with those of the lower row of cavities of the housing 6 shown in FIG. 14. The contact tails 34'" of these receptacle contacts extend down through respective holes in a printed circuit board PCB 4 in such a way that they do not obstruct the contact receiving face 12 of the housing 6'. Thus, the pins of a first pin header PH1 can be mated with the receptacle assembly by way of the contact receiving face 12' of the housing 6' or the pins of a second pin header PH2 can be mated with the assembly by way of the mating face 10' of the housing 6'.

Figure 16:
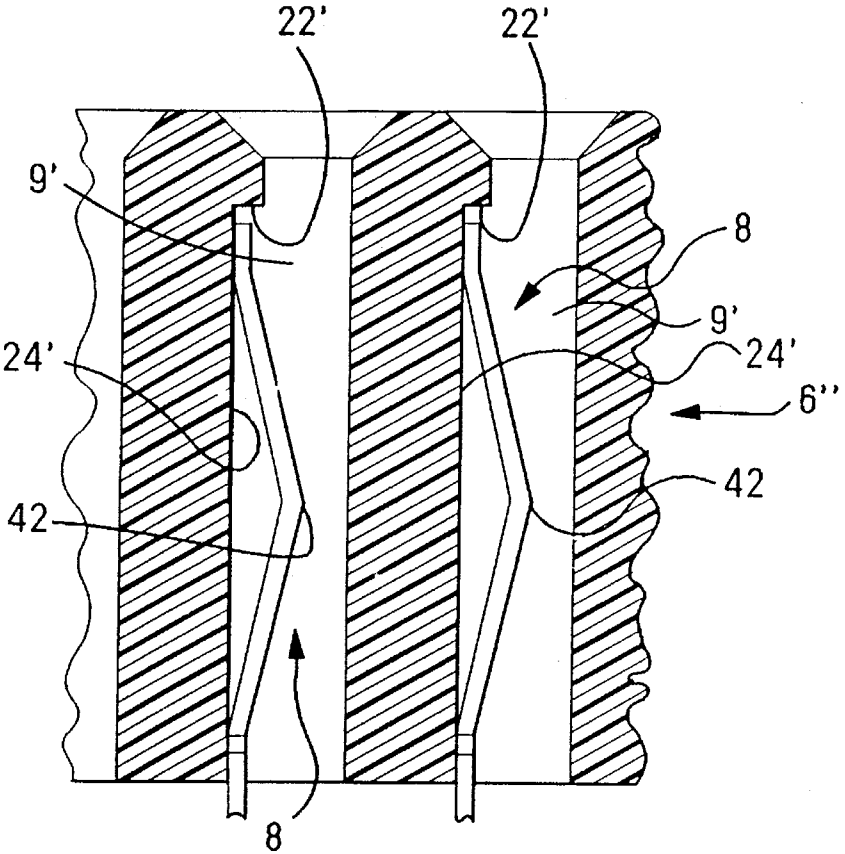
FIG. 16 is a fragmentary, diagrammatic cross sectional view of a further alternative embodiment of the receptacle assembly.

FIG. 16 shows, diagrammatically, an alternative embodiment including a housing 6" having rows of cavities 9' in which ledges 22' of the cavities 9' of adjacent rows project from the same wall surface 24' in the case of each of the adjacent cavities of the rows. The apices 42 of the spring contacts 8 in said adjacent cavities accordingly project in the same direction.

Figure 18:
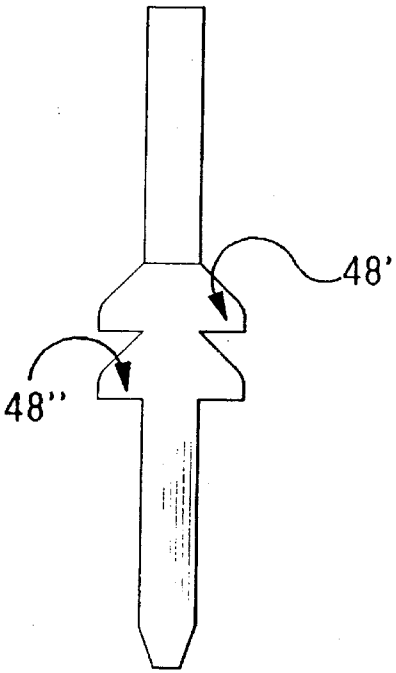
FIGS. 17 and 18 are a side view and a plan view, respectively, of another modified version of the spring contact.
Figure 17:
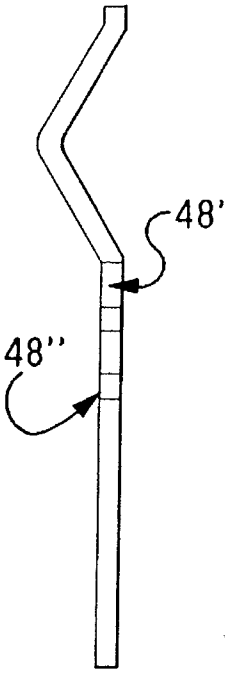

FIGS. 17 and 18 show a variant of the spring contacts 8, which the retention portion 33' of the contact has two pairs of retention ears 48' and 48", respectively, for biting into surfaces of slot 15.

Since the housing of each example described above, can be very simply molded because each cavity of the housing is defined by plane surfaces and the cavities are all of constant cross section up to the ledges 22, 22' and since each spring contact has but a single leaf contact spring, the receptacle connector assembly is highly susceptible to miniaturization. Thus, for example, a twenty position connector assembly having two equal rows of spring contacts, may be 2.5 cm in length, 0.5 cm in width and 0.6 cm in height. As will appear from the above description, the housing 6 can be used in a vertical, horizontal, through hole, or surface mounted receptacle connector assembly and the contact tails of the spring contacts can readily be adapted to such modes of use, the contact springs being identical for all of the modes. According to the mode of use of the assembly, a mating pin can be mated either by way of the mating face of the housing or by way of the contact receiving face of the housing. Since the housing is of regrindable material and the contact springs are of brass, the assembly can be recycled when its useful life is over. By virtue of the simplicity of the housing and the spring contacts and the ease with which they can be loaded into the housing, the assembly is compatible with global manufacture.

It is thought that the electrical connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

What is claimed is:

1. An electrical receptacle assembly for application to a printed circuit boar, the assembly comprising:

an insulating housing having a rectangular cross section defining at least one row of contact receiving cavities each opening into first and second opposite external faces of the housing, each cavity having a contact receiving part of constant cross section and being defined by first, second, third and fourth orthogonally arranged, flat, elongate surfaces extending substantially from the first opposite external face of the housing to a position proximate to the second opposite external face of the housing; and a spring contact in each cavity comprising a bowed, forward leaf contact spring extending from an intermediate planar retention portion having oppositely projecting retention ears, and a rearward contact tail extending from the retention portion, the retention portion being secured against the first flat surface by the retention ears, that extend into contact retention slots in communication with said first opposite external face, said contact retention slots coextending laterally along said first flat surface and into said second and third flat surfaces that are adjacent to said first and fourth flat surfaces, the contact tail projecting from the first external opposite face of the housing and the contact spring being bowed away from said first flat surface toward the fourth flat surface with a forward free ended portion of the contact spring engaging the first flat surface, whereby an electrical pin inserted axially into said cavity to engage against the fourth flat surface will depress the contact spring toward the first flat surface.

2. An assembly as claimed in claim 1, further comprising a ledge extending from the first flat surface proximate to the second external face of the housing for abutment by the free end of the forward free ended portion of the contact spring when it is depressed by the electrical pin to stop further forward travel of the free end.

3. An assembly as claimed in claim 1, wherein the forward free ended portion of the contact spring is coplanar with the intermediate retention portion of the spring contact.

4. An assembly as claimed in claim 1, wherein the contact spring has a forward rectilinear section and a rear rectilinear section both extending obliquely away from the first flat surface and cooperating to define a bight having an apex projecting towards the full flat surface.

5. An assembly as claimed in claim 4, wherein the forward and rear rectilinear sections of the contact spring are of substantially equal lengths and of equal width.

6. An assembly as claimed in claim 5, wherein the bight is displaced from the plane of the intermediate retention portion by a distance which is substantially equal to the stock thickness of the contact spring.

7. An assembly as claimed in claim 1, wherein the contacts tails have end portions projecting substantially at right angles to the first external surface of the housing for insertion into respective holes in a printed circuit board extending parallel to said first external surface.

8. An assembly as claimed in claim 1, wherein the contact tails have end portions extending parallel to the first external surface of the housing for soldering to conductors on a printed circuit board extending parallel to said first external surface.

9. An assembly as claimed in claim 1, wherein the contact tails have end portions extending parallel to said first external surface for insertion in holes in a printed circuit board extending at right angles to first external surface, with a side of an external surface of the housing adjacent to the first and second external surfaces of the housing abutting the printed circuit board.

10. An assembly as claimed in claim 1, wherein the cavities are of substantially rectangular cross section and open onto both of said first and second external faces and the contact tails are so configured as to allow pins to be mated with the receptacle assembly by way of either one of said first and second external surfaces of the housing.

11. An assembly as claimed in claim 1, wherein the housing is made of a regrindable material and the spring contacts are made of brass.

12. A stamped and formed electrical spring contact for an electrical receptacle assembly, the spring contact comprising a forward leaf contact spring, an intermediate planar retention portion and a rearward contact tail, the contact spring extending from the retention portion in the opposite direction to the contact tail, the contact spring having a forward end portion which is coplanar with the planar retention portion, a rectilinear forward section extending obliquely rearwardly from said forward end portion, and a rectilinear rear section extending obliquely forwardly from the retention portion, said forward and rear sections of the contact spring defining a bight having an apex for engagement with an electrical pin, the apex being displaced from the common plane of the rectilinear portion and the forward end portion of the contact spring at right angles to said common plane.

13. A spring contact as claimed in claim 12, wherein the forward and rear sections of the contact spring define an obtuse angle, said bight being displaced from said common plane substantially by the stock thickness of the retention portion.

14. A spring contact as claimed in claim 12, wherein the stock thickness of the contact spring, forward end portion of the contact spring, the retention portion and the contact tail is the same.

15. A spring contact as claimed in claim 12, wherein the contact tail is coplanar with the retention portion.

16. A spring contact as claimed in claim 12, wherein the forward and rear sections of the contact spring are of equal length and of equal width and of equal stock thickness, the apex of the contact spring presenting an undivided contact surface.

17. An electrical receptacle assembly comprising an insulating housing defining at least one row of contact receiving through cavities each opening into a mating face and an opposite contact receiving face of the housing, a ledge in each cavity facing the contact receiving face, the cavity being otherwise of constant, substantially rectangular cross section, a one piece spring contact consisting of a free ended, bowed, contact spring, a planar intermediate retention portion provided with opposed retention ears, and a contact tail, being disposed in each cavity with the retention portion lying against one wall of the cavity, with a free end portion of the contact spring proximate to the ledge and coplanar with the retention portion and with the contact tail projecting from the contact receiving face, the contact spring being bowed towards a wall of the cavity opposite to said one wall and the retention ears extending and biting into respective slots of the cavity adjacent to said one wall.

18. An assembly as claimed in claim 17, wherein the housing has two rows of said cavities, the contact springs of the spring contacts in the cavities of one row being bowed in the opposite direction of the contact springs of the spring cavities in the other row.

19. An assembly as claimed in claim 17, wherein the housing has two rows of said cavities, the contact tails of the spring contacts of the cavities of one row extending across the contact receiving face beyond the cavities of the other row and beyond the housing for insertion in respective holes in a printed circuit board, the contact tails of the spring contacts in the cavities of the other row projecting between the contact receiving face and the contact tails of the spring contacts in the cavities of the one row, and beyond the housing in parallel relationship with contact tails of the spring contacts in the cavities of the one row, for insertion in further respective holes in the printed circuit board.

20. An assembly as claimed in claim 17, wherein each contact spring consists of two rectilinear sections and said end portion, the rectilinear sections extending obliquely from said one wall towards said opposite wall to define a bight and being of substantially equal length, the bight being spaced from said one wall by substantially the stock thickness of the contact spring.

* * * * *